US005993571A

United States Patent [19]

Eto et al.

[11] Patent Number: 5,993,571

[45] Date of Patent: Nov. 30, 1999

[54] STEEL FOR MACHINE STRUCTURAL USE AND MACHINE PARTS MADE FROM SUCH STEEL

[75] Inventors: Hirohito Eto, Kawasaki; Hiromasa Takada, Muroran; Tetsuroh Hashiguchi, Muroran; Osamu Ohyama, Muroran, all of Japan

[73] Assignee: Isuzu Motors Limited and Nippon Steel Corporation, Toyko, Japan

[21] Appl. No.: 09/193,643

[22] Filed: Nov. 18, 1998

[30] Foreign Application Priority Data

Nov. 18, 1997 [JP] Japan ..... 9-317347

[51] Int. Cl.[6] ..... C22C 38/12; C22C 38/60; C22C 38/04; C21D 7/13

[52] U.S. Cl. ..... 148/320; 148/333; 148/334; 148/648; 148/649; 420/124; 420/128; 420/87

[58] Field of Search ..... 148/320, 333, 148/334, 648, 649; 420/124, 128, 84

[56] References Cited

U.S. PATENT DOCUMENTS 5,252,153 10/1993 Ochi et al. ..... 148/598

5,769,970 6/1998 Robelet et al. ..... 148/320

FOREIGN PATENT DOCUMENTS 8-291373 11/1996 Japan .
9-3589 1/1997 Japan .
9-31594 2/1997 Japan .
9-111412 4/1997 Japan .

*Primary Examiner*—Deborah Yee
*Attorney, Agent, or Firm*—Rader, Fishman & Grauer PLLC

[57] ABSTRACT

A steel for machine structural use, essentially having the following chemical composition:

C: 0.45–0.60 wt %,

Si: 0.50–2.00 wt %,

Mn: 0.10–0.30 (0.30 not inclusive) wt %,

P: 0.01–0.10 wt %,

S: 0.01–0.20 wt %,

V: 0.08–0.15 wt %, and

N: 0.0020–0.0050 (0.0050 not inclusive) wt %. The remainder is Fe and impurities inevitably included. The inner structure of the steel is a ferrite-pearlite structure.

20 Claims, 4 Drawing Sheets

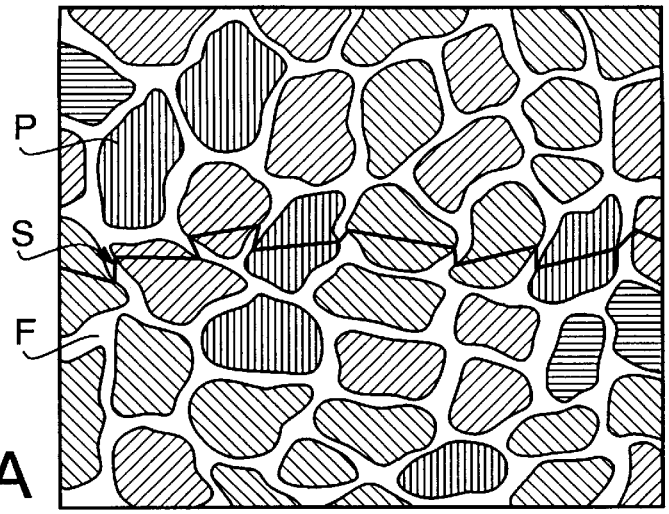
FIG.1A
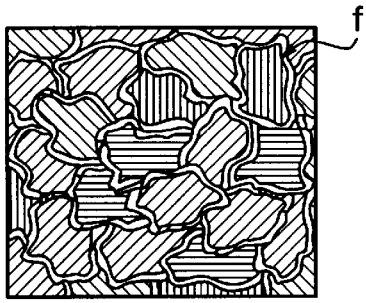
FIG.1B
FIG. 2
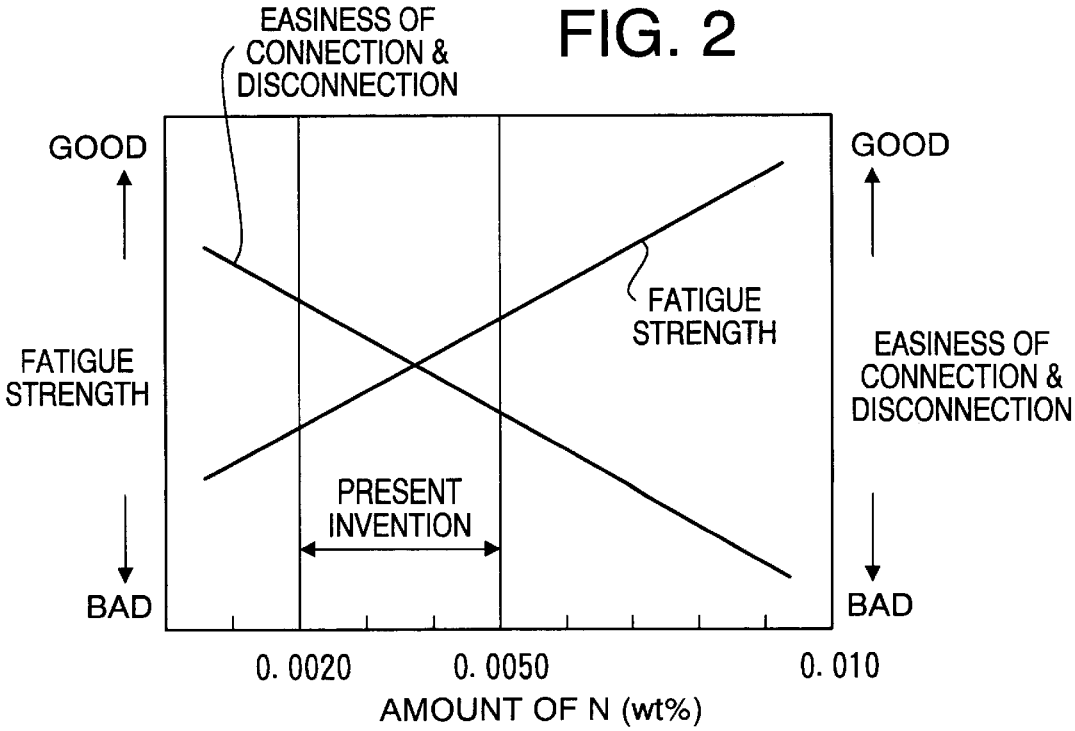

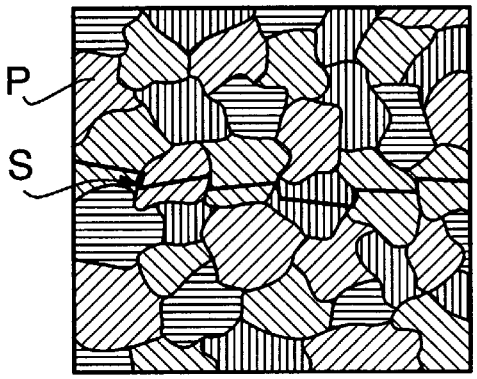
FIG.7A
PRIOR ART
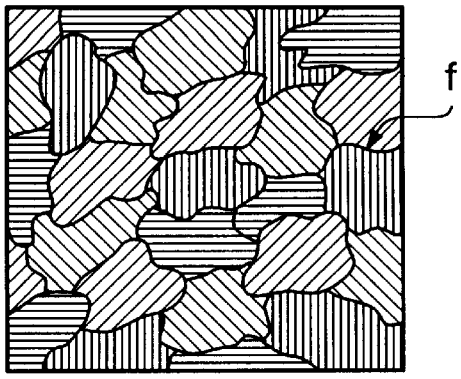
FIG.7B
PRIOR ART
FIG.8A
PRIOR ART
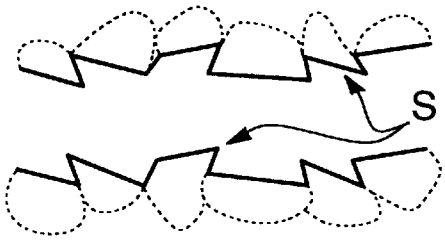
FIG.8B
PRIOR ART
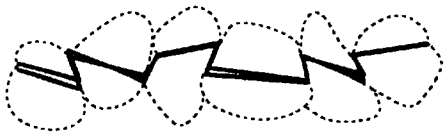

STEEL FOR MACHINE STRUCTURAL USE AND MACHINE PARTS MADE FROM SUCH STEEL

BACKGROUND OF THE INVENTION

1. Field of the Invention

The present invention generally relates to carbon steel for machine structural use and machine parts fabricated from this carbon steel and divided by fracture process, and more particularly to such carbon steel and machine parts used as material and parts of an internal combustion engine, a piston compressor or a piston pump.

2. Description of the Related Art

Connecting rods of internal combustion engines are an example of machine parts made from steel for machine structural use or alloy steel and divided by cutting or fracturing. One way of dividing a connecting rod to two pieces of material (cap portion and main body portion) by cutting is schematically illustrated in FIGS. 3A to 3D of the accompanying drawings. First, as illustrated in FIG. 3A, a machining work is applied to an inner annular surface 10*a* of a bore formed in a large end 10 of connecting rod blank 11. Then, as illustrated in FIG. 3B, the blank 11 is cut to a body portion 12 and a cap portion 13 by a cutting device such as a sawtooth. The cap 13 is separated from the body portion 12 as illustrated in FIG. 3C, and a finishing work is applied to cut surfaces 12*a* of the main body portion 12 and cut surfaces 13*a* of the cap 13. After that, the main body portion 12 and cap 13 are abutted to each other at their cut surfaces 12*a* and 13*a* and joined by bolts 14 as shown in FIG. 3D. Finally, the assembled connecting rod 15 undergoes a finishing process.

A conventional way of dividing a connecting rod by fracturing is illustrated in FIGS. 4A to 4C of the accompanying drawings. It should be noted that like reference numerals are assigned to like parts in FIGS. 3A to 3D and 4A to 4C.

According to a conventional way of dividing a connecting rod blank 11 by fracture process, the step of cutting the large end 10 of the connecting rod blank 11 by a cutter (FIG. 3B) and the step of finishing the cut surfaces 12*a* and 13*a* (FIG. 3C) are not needed. Referring to FIG. 4A, two opposed cutouts or notches K are formed in the inner surface 10*a* of the large end 10 so that these cutouts or notches K will be starting points of fracture as illustrated in FIG. 4B. End faces or fracture surfaces 22*a* and 23*a* of the main body portion 22 and cap 23 created upon fracturing do not undergo the finishing process. These fracture surfaces 22*a* and 23*a* are simply abutted against each other and the main body portion 22 and the cap 23 are joined together by bolts 14 to form a connecting rod 25 as illustrated in FIG. 4C.

The fracturing method contributes to cost reduction in connecting rod manufacturing so that it is prevailing now.

A known steel material used for the fracturing method is a high carbon steel (C: 0.65–0.75 wt %) which easily and smoothly fractures and less deforms. In order not to give ductility to the material, however, this high carbon steel is used after hot forging without heat treatment, i.e., heat treatment such as quench hardening and tempering is not applied to the material after hot forging. In spite of small deformation, however, a high carbon non-heat treated steel has a problem that mating (connection and separation) between the fracture surfaces of the material created upon fracturing is not so good and a yield strength is low.

In consideration of the above, Japanese Patent Application, Laid Open Publication Nos. 8-291373, 9-3589 and 9-31594 teach a high strength, low ductility, non-heat treated steel which possesses the same or greater tensile strength as or than a common carbon steel. This is a one piece material made by hot forging, and if divided by fracture process at room temperature, the fracture surfaces will be flat brittle surfaces. However, when a connecting rod is manufactured from the above mentioned high strength, low ductility, non-heat treated steel and used for an engine operated under a severe condition such as sudden acceleration, buckling possibly occurs since a yield strength of this steel is not always sufficient. Therefore, it is requested to raise a yield ratio (yield strength/tensile strength) so as to increase the yield strength, not to increase the tensile strength.

Japanese Patent Application, Laid-Open Publication No. 9-111412 teaches a high strength, low ductility, non-heat treated steel of which yield ratio is raised. This improvement demonstrates a yield ratio of 0.7 or more if Si, V and P are added in amounts greater than certain values respectively. If the yield ratio is not less than 0.7 and elongation in the tensile test at room temperature is 10% or less, flat brittle fracture surfaces result upon dividing by fracture process. Further, if the amounts of C, Si, Mn, Cr, V and S to be added are appropriately adjusted, the steel will have a tensile strength over 800 MPa.

However, even such high strength, low ductility, non-heat treated steel has problems; it deforms greatly upon breakage and mating properties between fracture surfaces are not good.

Relationship between C content and heating temperature during forging is depicted in FIG. 5 of the accompanying drawings.

A high carbon steel which is practically used in a fracturing method contains a large amount of C (about 0.65–0.75 wt %) so that as understood from the graph of FIG. 5 the forge heating temperature should be low (about 1,100–1,200° C.: zone Z in FIG. 5). This raises problems such as shortening of life of dies (metallic molds) used in forging and a relatively long preparation time required due to switching of heating temperature before forging.

Relationship between the number of cycles to failure and stress is illustrated in FIG. 6. The solid line indicates a steel (JIS S70C) without heat treatment after forging (HB282), the broken line indicates a heat-treated steel (JIS S53C) (HB255), and the chain line indicates another heat-treated steel (JIS S53C) (HB285).

As seen in the diagram of FIG. 6, the high carbon steel as forged (solid line) has a fatigue strength which is considerably inferior to a heat-treated material having similar hardness. Thus, if the high carbon steel must have a sufficient fatigue strength without heat treatment, its hardness should be raised. However, this results in degradation of machinability.

A structure of a conventional high carbon steel is diagrammatically illustrated in FIGS. 7A and 7B of the accompanying drawings. Particularly, FIG. 7A shows a progress of breaking or fracturing "S" in the structure by cleavage and FIG. 7B shows the resulting fracture surface "f". FIG. 8A of the accompanying drawings schematically illustrates the two fracture surfaces "S" as separated and FIG. 8B illustrates mating of the fracture surfaces. In general, the high carbon steel has a 100% pearlite structure "P" (FIG. 7A) if no heat treatment is applied after forging. Therefore, the stepwise lines of cleavage "S" in FIGS. 7A and 8A or the fracture surface "f" in FIG. 7B is defined by a pearlite grain boundary. This burr-like fracture line "S" is schematically depicted in FIG. 8A. When these two burr-like surfaces are jointed, engagement is very firm. However, a connecting rod is assembled, dissembled or reassembled (i.e., a cap is joined to a main body portion of the connecting rod, separated therefrom and rejoined) by a manufacture worker, mechanic or service man by hands. If connection between the cap and the main body portion of the connecting rod is so firm, it is impossible to divide the connecting rod (to separate the cap from the main body portion) by hands and a special tool is required.

In sum, the above described conventional high carbon steel, even if mating properties of fracture surfaces and yield strength are both improved, does not have low deformability essential to industrial manufacturing, good fracture surfaces essential to easy assembling and dissembling by hands, and high fatigue strength not inferior to heat-treated steel.

SUMMARY OF THE INVENTION

One object of the present invention is to provide a steel for machine structural use which has sufficient strength, yield ratio and fatigue limit ratio (tensile strength ratio), and good machinability.

Another object of the present invention is to provide, using the above mentioned steel, a machine part made by fracture process which deforms little upon fracturing, has fracture surfaces easy to assemble, dissemble and reassemble, and possesses a high fatigue strength.

According to one aspect of the present invention, there is provided a steel for machine structural use, essentially having the following chemical composition:

C: 0.45–0.60 wt %,

Si: 0.50–2.00 wt %,

Mn: 0.10–0.30 (0.30 not inclusive) wt %,

P: 0.01–0.10 wt %,

S: 0.01–0.20 wt %,

V: 0.08–0.15 wt %, and

N: 0.0020–0.0050 (0.0050 not inclusive) wt %, with the remainder being Fe and impurities inevitably included. The inner structure is a ferrite-pearlite structure. The inventors confirmed that the yield ratio, fatigue limit ratio and machinability of this steel were good. Further, when the steel is divided by fracture method, joined and separated, the inventors confirmed that a force needed to separate the material was small and it was separatable by hands.

According to another aspect of the present invention, there is provided a machine part fabricated from the above described steel. The steel is melted and cast to a particular shape. Then, the steel undergoes a hot rolling process or hot forging process to provide a machine part which less deforms upon fracturing, exposes preferred fracture surfaces upon fracturing, has fracture surfaces easy to assemble, dissemble and reassemble, and possesses a high fatigue strength.

BRIEF DESCRIPTION OF THE DRAWINGS

FIG. 1A diagrammatically illustrates a progress of cleavage in a structure of a steel for machine structural use according to the present invention when the steel is fractured;

FIG. 1B illustrates a fracture surface of the steel shown in FIG. 1A as made by fracture process;

FIG. 2 is a diagram illustrating relationship between N content, fatigue strength and easiness in assembling and dissembling of two fracture pieces of material;

FIG. 7A diagrammatically illustrates a progress of cleavage in a structure of a common high carbon steel as made by fracture process;

FIG. 7B illustrates a fracture surface of the steel shown in FIG. 7A as made by fracture process;

FIG. 8A illustrates two separated fracture surfaces as obtained by fracture process of FIG. 7A; and FIG. 8B illustrates mating of the two fracture surfaces.

DETAILED DESCRIPTION OF THE INVENTION

Figure 3A:
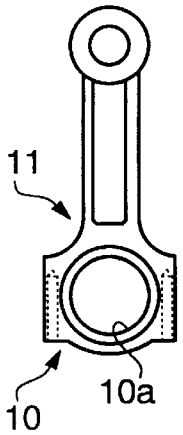
FIG.3A PRIOR ART
FIG. 3A illustrates a front view of a connecting rod blank.
Figure 3B:
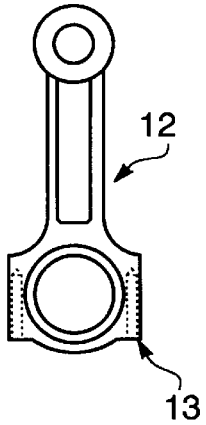
FIG.3B PRIOR ART
FIG. 3B illustrates the connecting rod blank as cut.
Figure 3C:
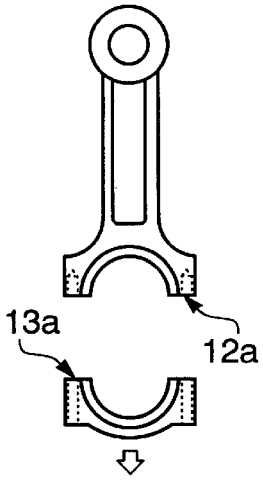
FIG.3C PRIOR ART
FIG. 3C illustrates a cap and a main body portion of the connecting rod blank as divided after cutting, with cut surfaces being finished.
Figure 3D:
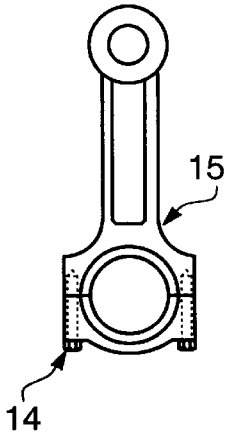
FIG.3D PRIOR ART
FIG. 3D illustrates the assembled connecting rod as united by bolts.
Figure 4A:
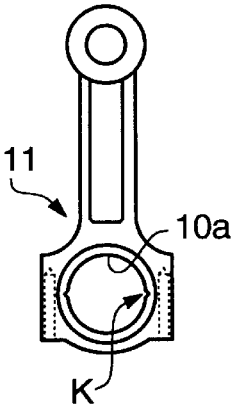
FIG.4A PRIOR ART
FIG. 4A illustrates a front view of another connecting rod blank having notches in its large end.
Figure 4B:
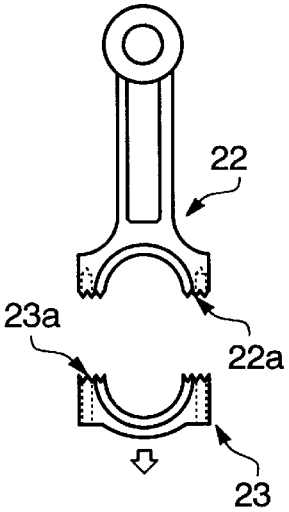
FIG.4B PRIOR ART
FIG. 4B illustrates a cap and a main body portion of the connecting rod blank as divided by fracture process.
Figure 4C:
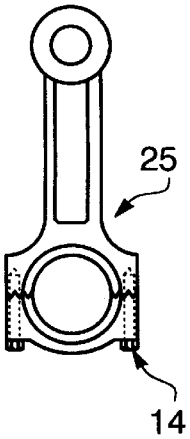
FIG.4C PRIOR ART
FIG. 4C illustrates the assembled connecting rod as united by bolts.
Figure 5:
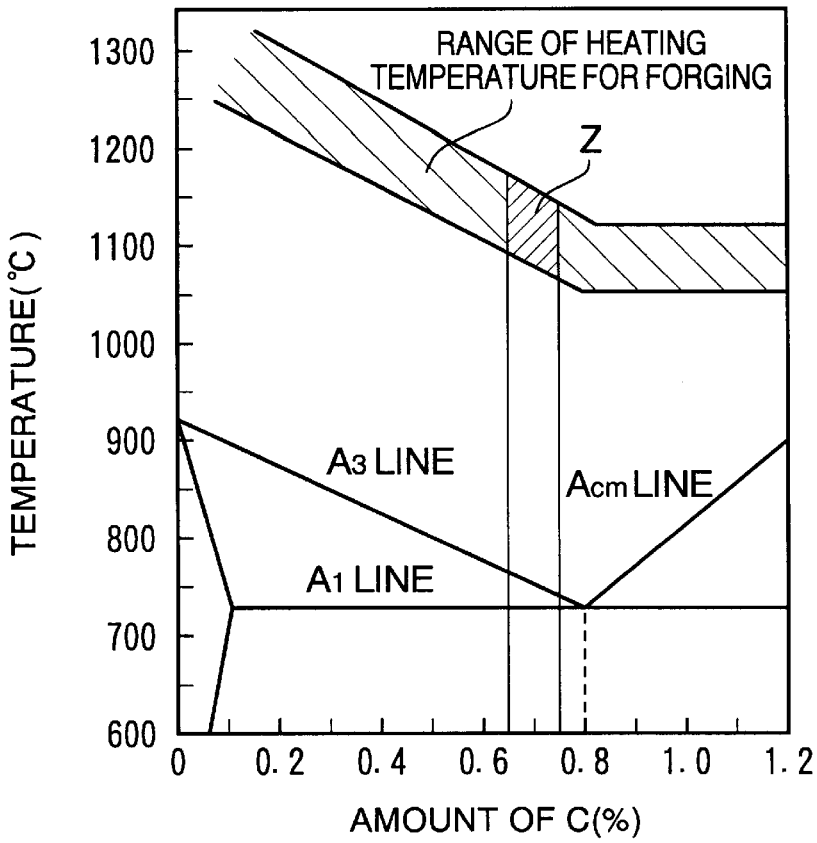
FIG. 5 PRIOR ART
FIG. 5 illustrates relationship between C content and heating temperature during forging.
Figure 6:
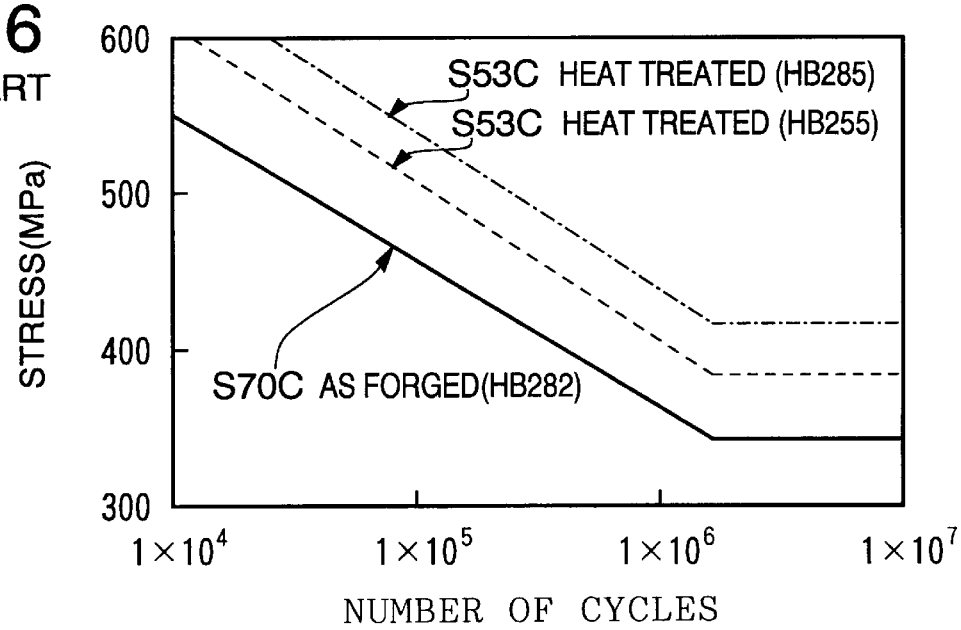
FIG. 6 PRIOR ART
FIG. 6 illustrates relationship between the number of cycles to failure and stress.

Now, an embodiment of a steel for machine structural use and a machine part made from this steel according to the present invention will be described in reference to the accompanying drawings.

First, three basic ideas embodied in the steel of the present invention will be described.

(1) Improvement on fracturability

Mn is an element to reinforce a steel by solution strengthening. Mn has an advantage that it does not degrade ductility very much but can raise the strength. For this reason, Mn of about 0.6 wt % or more is generally added to a medium carbon steel for machine structural use.

Perceiving this function of Mn, the inventors studied relationship between Mn and fracturability. Experiments revealed that there is an intimate correlation between an amount of deformation upon fracturing and an amount of Mn added. In particular, it was found that when Mn was contained less than 0.3 wt %, ductility of the steel (contraction or reduction in a tensile test) considerably dropped, deformation during fracturing was reduced, and flat fracture surfaces resulted upon cleavage.

V or Nb was added to a non-heat treated steel as a precipitation hardening element. It was found also that if this element was combined with N in the steel and became a nitride, then an austenite crystal grain became a fine structure during heating in a forging process and therefore it was impossible to obtain a sufficiently low ductility (high fracturability).

Thus, it is quite important to reduce amounts of Mn and N to be contained in the steel, in order to improve fracturability of the steel.

(2) Improvement on dividability after joining (easiness in assembling and dissembling of two parts resulting from fracturing a single part)

A machine part (e.g., connecting rod) is for example assembled by joining two smaller parts (e.g., a main body portion and a cap) at mating surfaces and uniting by bolts. The mating surfaces are fracture surfaces made by fracture process. The machine part is dissembled by unscrewing the bolts and separating one part from the associated part. The assembling and dissembling are generally performed by worker's hands. In order to raise easiness in assembling and dissembling, the mating surfaces of the two parts created upon cleavage should not have burr-like surfaces.

The high carbon steel tends to have burr-like fracture surfaces upon fracturing since the fracture surfaces have pearlite grains. However, by changing the structure to a ferrite-pearlite structure, the fracture (cleavage) surfaces have a soft pro-eutectoid ferrite. These surfaces have less and smaller concaves and convexes.

If the crystal grain of the steel is fined by a pinning effect of VN in order to raise the fatigue strength, the number of concaves and convexes per a specific area on a fracture surface increases. This deteriorates easiness in assembling and dissembling of two parts made by fracture process. Thus, it is necessary to adjust an amount of N to be not more than a predetermined value so that the crystal grain becomes larger than a certain size.

Therefore, it is very important to reduce an amount of N in the steel in order to improve dividability of two parts.

In order to obtain low ductility which is industrially satisfactory (i.e., small deformation upon fracturing) and appropriately rough and brittle fracture surfaces which provide good mating in assembling and dissembling, it is requisite to reduce Mn and N in the steel.

(3) Improvement on yield strength and fatigue strength

It is feasible to realize preferred machinability while maintaining high yield strength by raising a yield ratio (yield strength/tensile strength) of a ferrite-pearlite steel. The fatigue limit ratio is also improved at the same time. Specifically, by causing the steel to have a ferrite-pearlite structure and to have low hardness and high yield strength, the machinability is improved.

When the yield strength is raised, the fatigue strength is raised if compared with a steel having the same tensile strength. In order to raise the yield ratio, it is needed to reduce an amount of carbon when compared with a conventional steel for machine structural use, and to positively take advantage of precipitation hardening caused by V, Nb or other elements.

Referring now to FIGS. 1A and 1B, will be described a structure of the steel for machine structural use according to the present invention. FIG. 1A diagrammatically illustrates a progress of cleavage in the structure upon fracturing and FIG. 1B diagrammatically illustrates a fracture surface created upon fracturing. It should be noted that similar symbols are used in FIGS. 1A, 1B, 7A and 7B.

The steel for machine structural use has the following chemical composition:

C: 0.45–0.60 wt %,

Si: 0.50–2.00 wt %,

Mn: 0.10–0.30 (0.30 not inclusive) wt %,

P: 0.01–0.10 wt %,

S: 0.01–0.20 wt %,

V: 0.08–0.15 wt %, and

N: 0.0020–0.0050 (0.0050 not inclusive) wt %, with the remainder being Fe and impurities inevitably included. As illustrated in FIG. 1A, the inner structure of this steel is a ferrite (F)-pearlite (P) structure.

Numerical limitations indicated in the above chemical composition have the following reasons:

The C content is limited to 0.45–0.60 wt % since a necessary strength is insured when C is contained 0.45 wt % or more and a yield ratio and a fatigue limit ratio are both raised when C is contained 0.60 wt % or less.

Si lowers ductility so that it has an effect of improving fracturability. The Si content is limited to 0.50–2.00 wt % since ductility does not drop very much when Si is less than 0.50 wt % and hot ductility drops when Si is more than 2.00 wt %. Dropping of hot ductility often results in flaw of the product during manufacturing and hot forging of the steel.

Mn is a solution strengthening element to reinforce the steel while not deteriorating ductility very much. The Mn content is limited to 0.10–0.30 (0.30 excluded) wt % in this embodiment. If Mn is less than 0.10 wt %, S becomes a solid solution state when heated, and therefore hot ductility is lowered, which often results in flaw or scar during manufacturing and hot forging of the steel. Mn is limited to less than 0.30 wt % since deformation upon fracturing is reduced and relatively flat and brittle fracture surfaces result.

P is an element to make the steel brittle. The P content is limited to 0.01–0.10 wt % since sufficient fracturability is not obtained when less than 0.001 wt %, and hot ductility greatly drops when more than 0.10 wt %.

S is an element to improve machinability. The S content is limited to 0.01–0.20 wt % since satisfactory machinability is not obtained when less than 0.01 wt % and a large amount of MnS particles is produced when more than 0.20 wt %. These MnS particles deteriorate a fatigue strength.

The V content is limited to 0.08–0.15 wt % since steel yield strength and fatigue strength are improved due to precipitation strengthening when contained 0.08 wt % or more, and ductility is lowered and fracturability is improved at the same time. When V is contained more than 0.15 wt %, hardness is unnecessarily raised and machinability is lowered.

N precipitates in the form of VN in the steel thereby fining the crystal grain, raising ductility and lowering easiness in uniting and separating fracture surfaces made by cleavage. Thus, the N content is limited to less than 0.0050 wt %. Reducing the N content to less than 0.0020 wt % does not strengthen the above mentioned functions of N, and raises a steel manufacturing cost. Thus, the lower limit of N is determined to be 0.0020 wt % in this embodiment.

When Al deoxidization is performed, hard alumina disperses in the steel and machinability is deteriorated. Basically, therefore, Al is not added. Performing no Al deoxidization results in another advantage; the structure becomes coarse and fracturability is raised. However, Al of 0.005 wt % or more may be added to obtain a deoxidization effect when the tensile strength is relatively low or a margin for machining is small. This is because machinability will not become a problem. Adding Al more than 0.050 wt % does not enhance the deoxidization effect.

If TiN is precipitated in the steel upon Ti deoxidization, the structure of after hot forging is fined and ductility is raised. Fundamentally, therefore, Ti deoxidization or Ti addition is not conducted. However, sufficiently low ductility is obtained even after Ti deoxidization if the steel hardness is sufficiently high. In this case, when Ti addition is less than 0.005 wt %, satisfactory deoxidization is not acquired. When more than 0.050 wt %, a coarse Ti deposit is produced and machinability is lowered.

It should be noted that at least one of the following elements may be added to the steel for machine structural use of the invention depending upon given conditions: 0.4 wt % or less of Pb, Bi or Se, or 0.050 wt % or less of Te, or 0.0030 wt % or less of Ca.

The C content of the steel of the present invention is 0.45–0.60 wt % which is smaller than a common high carbon steel. Therefore, the inner structure of the steel is a ferrite-pearlite structure. As illustrated in FIGS. 1A and 1B, the zigzag cleavage line "S" or the fracture surface "f" has a pro-eutectoid ferrite. This also prevents the cleavage line "S" from becoming like burr. As a result, two cleavage surfaces are not engaged with each other very firmly when joined. Thus, a worker can separate the two parts by hands. A special jig is not necessary.

The mating surfaces of two parts, i.e., the cleavage surfaces "S" (FIG. 1A) , are easy to join and separate if the hardness is low. However, if the crystal grain diameter became too small due to, for example, an addition of Al or Ti to raise fatigue strength, an engagement portion per specific (unit) area would increase. This will make joining and separating of two parts uneasy. Thus, the balance between the fatigue strength and easiness of connection and separation should be considered. In the invention, the N content is controlled to 0.0020–0.0050 wt % (0.0050 itself excluded) thereby having a preferred crystal grain size.

By controlling the amount of N to restrain precipitation of nitride, the austenite crystal grain becomes coarse during heating for forging. This lowers ductility.

The relationship between N, fatigue strength and easiness of connection and separation of two parts divided by fracture process is illustrated in FIG. 2. The horizontal axis of the diagram indicates the amount of N contained in the steel. The left vertical axis indicates the fatigue strength and right vertical axis indicates easiness of connection and disconnection of two parts separated by fracture process.

As seen in the diagram of FIG. 2, the steel for machine structural use according to the present invention includes N of controlled amount, i.e., 0.0020–0.0050 wt %. Thus, the balance between the fatigue strength and the easiness of connection and disconnection is good.

The structure of the steel is limited to ferrite-pearlite in the present invention. However, no special manufacturing method or forging method is needed to the steel of the invention. When the raw material metal having the chemical composition as described above is melted and cast according to a common steel manufacturing method in an ordinary steel mill and hot rolled under a normal condition to a rod steel, the steel structure naturally becomes a ferrite-pearlite structure. Even if the rod steel is further hot forged to a particular shape suited for an automobile part and cooled by air or a fan, the steel structure is also ferrite-pearlite.

EXAMPLES 39 kinds of steel having different chemical compositions, each weighing 150 kg, were melted in a vacuum melting furnace and forged to a plate having a cross section of 20 mm×60 mm. The plate was heated to 1,473° K and air cooled. Experimental pieces Nos. 1–26 according to the present invention and Nos. 1–13 according to the prior art were prepared in this manner. The chemical compositions of the specimens are shown in Tables I to III.

Nos. 1–8 specimens of the invention have a chemical composition including C, Si, Mn, P, S, V and N. No.1 specimen of the prior art has a chemical composition including C, Si, Mn, P, S, Cr, V and N. The latter is a conventional high carbon non-heat treated steel. Nos.2–7 prior art specimens have a chemical composition including C, Si, Mn, P, S, V and N, at least one of which elements is contained outside the range of the invention.

Nos. 9–13 invention specimens have a chemical composition including C, Si, Mn, P, S, V, N, Al and/or Ti. Nos. 8–10 prior art specimens contain Al and/or Ti outside the range of the invention.

Nos. 14–26 invention specimens have a chemical composition including C, Si, Mn, P, S, V, N and at least one or two of Cr, Mo, Nb, Al or Ti. In Nos. 11–13 prior art specimens, at least one of Cr, Mo or Nb is included outside the range of the invention.

TABLE I

| EXAMPLES | | CHEMICAL COMPOSITION | | | | | | | |
|---|---|---|---|---|---|---|---|---|---|
| | | C | Si | Mn | P | S | Cr | V | N |
| IN-VEN-TION | 1 | 0.55 | 0.52 | 0.20 | 0.019 | 0.010 | — | 0.081 | 0.0038 |
| | 2 | 0.46 | 1.94 | 0.18 | 0.022 | 0.045 | — | 0.103 | 0.0024 |
| | 3 | 0.60 | 0.55 | 0.24 | 0.022 | 0.055 | — | 0.121 | 0.0027 |
| | 4 | 0.52 | 0.50 | 0.38 | 0.014 | 0.055 | — | 0.080 | 0.0028 |
| | 5 | 0.51 | 0.52 | 0.11 | 0.056 | 0.051 | — | 0.101 | 0.0040 |
| | 6 | 0.53 | 1.00 | 0.35 | 0.055 | 0.092 | — | 0.114 | 0.0047 |
| | 7 | 0.45 | 1.33 | 0.22 | 0.094 | 0.053 | — | 0.150 | 0.0039 |
| | 8 | 0.47 | 0.59 | 0.17 | 0.032 | 0.179 | — | 0.148 | 0.0030 |
| PRIOR ART | 1 | 0.72 | 0.23 | 0.81 | 0.021 | 0.060 | 0.24 | 0.052 | 0.0070 |
| | 2 | 0.55 | 0.55 | 0.50 | 0.049 | 0.058 | — | 0.115 | 0.0033 |
| | 3 | 0.54 | 0.62 | 0.32 | 0.047 | 0.060 | — | 0.119 | 0.0101 |
| | 4 | 0.37 | 0.52 | 0.55 | 0.020 | 0.008 | — | 0.188 | 0.0034 |
| | 5 | 0.80 | 0.50 | 0.10 | 0.045 | 0.042 | — | 0.049 | 0.0049 |
| | 6 | 0.51 | 0.24 | 0.32 | 0.022 | 0.056 | — | 0.087 | 0.0085 |
| | 7 | 0.49 | 2.45 | 0.33 | 0.121 | 0.032 | — | 0.031 | 0.0037 |

(UNIT: wt %)

TABLE II

| EXAMPLES | | CHEMICAL COMPOSITION | | | | | | | |
|---|---|---|---|---|---|---|---|---|---|
| | | C | Si | Mn | P | S | V | N | OTHERS |
| INVENTION | 9 | 0.54 | 0.75 | 0.22 | 0.045 | 0.077 | 0.110 | 0.0044 | Al: 0.007 |
| | 10 | 0.53 | 0.55 | 0.32 | 0.044 | 0.069 | 0.106 | 0.0041 | Al: 0.050 |
| | 11 | 0.54 | 0.50 | 0.34 | 0.045 | 0.072 | 0.108 | 0.0034 | Ti: 0.010 |
| | 12 | 0.55 | 0.58 | 0.34 | 0.045 | 0.068 | 0.110 | 0.0036 | Ti: 0.045 |
| | 13 | 0.55 | 0.57 | 0.30 | 0.049 | 0.078 | 0.111 | 0.0040 | Al: 0.024<br>Ti: 0.017 |
| PRIOR ART | 8 | 0.52 | 0.60 | 0.33 | 0.050 | 0.109 | 0.141 | 0.0034 | Al: 0.061 |
| | 9 | 0.55 | 0.61 | 0.30 | 0.050 | 0.121 | 0.140 | 0.0045 | Ti: 0.078 |
| | 10 | 0.56 | 0.61 | 0.29 | 0.053 | 0.111 | 0.138 | 0.0037 | Al: 0.060<br>Ti: 0.064 |

(UNIT: wt %)

TABLE III

| EXAMPLES | | CHEMICAL COMPOSITION | | | | | | | | | | |
|---|---|---|---|---|---|---|---|---|---|---|---|---|
| | | C | Si | Mn | P | S | Cr | Mo | V | Nb | N | OTHERS |
| INVENTION | 14 | 0.47 | 1.10 | 0.37 | 0.019 | 0.033 | 0.20 | — | 0.133 | — | 0.0034 | — |
| | 15 | 0.48 | 1.07 | 0.38 | 0.017 | 0.030 | 0.49 | — | 0.130 | — | 0.0035 | — |
| | 16 | 0.48 | 1.07 | 0.40 | 0.019 | 0.035 | — | — | 0.130 | 0.07 | 0.0038 | — |
| | 17 | 0.45 | 0.98 | 0.36 | 0.022 | 0.034 | — | — | 0.080 | 0.27 | 0.0029 | — |
| | 18 | 0.52 | 0.51 | 0.25 | 0.045 | 0.055 | — | 0.09 | 0.091 | — | 0.0038 | — |
| | 19 | 0.53 | 0.50 | 0.25 | 0.044 | 0.057 | — | 0.46 | 0.097 | — | 0.0036 | — |
| | 20 | 0.46 | 0.74 | 0.22 | 0.021 | 0.150 | 0.24 | — | 0.125 | 0.12 | 0.0040 | — |
| | 21 | 0.46 | 0.72 | 0.20 | 0.022 | 0.147 | 0.45 | 0.21 | 0.108 | — | 0.0042 | — |
| | 22 | 0.45 | 0.75 | 0.21 | 0.028 | 0.162 | — | 0.49 | 0.105 | 0.09 | 0.0038 | — |
| | 23 | 0.47 | 0.72 | 0.22 | 0.023 | 0.174 | 0.12 | 0.20 | 0.149 | 0.13 | 0.0037 | — |
| | 24 | 0.50 | 1.41 | 0.17 | 0.041 | 0.060 | 0.36 | — | 0.120 | — | 0.0035 | Al: 0.027 |
| | 25 | 0.51 | 1.45 | 0.16 | 0.040 | 0.055 | 0.35 | 0.20 | 0.112 | — | 0.0034 | Al: 0.010<br>Ti: 0.020 |
| | 26 | 0.50 | 1.38 | 0.11 | 0.041 | 0.062 | — | 0.20 | 0.122 | 0.08 | 0.0047 | Ti: 0.017 |
| PRIOR ART | 11 | 0.45 | 1.50 | 0.32 | 0.075 | 0.054 | 0.85 | — | 0.121 | — | 0.0046 | — |
| | 12 | 0.45 | 1.52 | 0.32 | 0.075 | 0.056 | — | 0.88 | 0.130 | — | 0.0040 | — |
| | 13 | 0.46 | 1.47 | 0.34 | 0.080 | 0.055 | — | — | 0.131 | 0.35 | 0.0042 | — |

(UNIT: wt %)

The steel structure of all the invention specimens and prior art specimens shown in Tables I to III was a ferrite-pearlite structure.

Next, pieces for tensile test (parallel portion diameter was 8 mm) and Ono rotating bending fatigue test (unnotched test piece having a parallel portion diameter of 8 mm) were prepared and these tests were conducted. In addition, $VL_{1000}$ (maximum peripheral speed which allows 1,000 mm cutting) was measured using a cemented carbide drill of 9 mm diameter.

Large connecting rods were also prepared in the following manner. First, a material was forged to a rod of 45 mm diameter. This rod steel was heated to 1,523 K by high frequency induction heating. Then, it was forged to a large connecting rod and cooled by a fan. Subsequent to this, machining was applied to a large end of the connecting rod and bolt holes were drilled in the large end. Two notches were made at opposite positions on an inner surface of the large end of the connecting rod. After that, the connecting rod was fractured by a hydraulic machine. Resulting two pieces of material were abutted against each other at their fracture surfaces and thread clamped with two 7T standard bolts by plastic region tightening method. Then, the bolts were removed from the connecting rod, and the cap of the connecting rod was separated from the main body portion of the connecting rod.

A moment needed to separate the cap from the main body portion was measured. When the moment exceeded 50 kgfcm (about $4.9\times10^4$ Nm), a service man could hardly separate the cap from the main body portion of the connecting rod by hands.

Tables IV to VI show results of various tests conducted to the twenty-six invention specimens and thirteen prior art specimens. It should be noted that deformation of the connecting rod upon fracturing (reduction of area in the fractured surface) is proportional to reduction of area upon tensile test so that "REDUCTION OF AREA" in Tables IV to VI represents a character or index of deformation upon fracturing.

TABLE IV

| EXAMPLES | | TEST DATA | | | | | | |
|---|---|---|---|---|---|---|---|---|
| | | TENSILE STRENGTH (MPa) | YIELD RATIO | REDUCTION OF AREA (%) | FATIGUE LIMIT RATIO | $VL_{1000}$ (m/min) | SEPARATING MOMENT (kgf · cm) | SEPARATING MOMENT ($\times10^4$N · m) |
| INVENTION | 1 | 787 | 0.60 | 31 | 0.43 | 14 | 29 | 2.8 |
| | 2 | 902 | 0.63 | 34 | 0.51 | 11 | 37 | 3.6 |
| | 3 | 843 | 0.58 | 26 | 0.44 | 18 | 36 | 3.5 |
| | 4 | 783 | 0.60 | 35 | 0.44 | 23 | 29 | 2.8 |
| | 5 | 764 | 0.63 | 32 | 0.44 | 24 | 37 | 3.6 |
| | 6 | 884 | 0.63 | 31 | 0.47 | 22 | 30 | 2.9 |
| | 7 | 909 | 0.67 | 36 | 0.49 | 12 | 29 | 2.8 |
| | 8 | 793 | 0.64 | 38 | 0.45 | 47 | 33 | 3.2 |
| PRIOR ART | 1 | 989 | 0.55 | 33 | 0.40 | 2 | 115 | 11.3 |
| | 2 | 878 | 0.61 | 46 | 0.45 | 16 | 67 | 6.6 |
| | 3 | 898 | 0.66 | 43 | 0.45 | 15 | 65 | 6.4 |
| | 4 | 838 | 0.69 | 47 | 0.49 | 9 | 92 | 9.0 |
| | 5 | 870 | 0.50 | 15 | 0.38 | 13 | 27 | 2.6 |
| | 6 | 780 | 0.65 | 47 | 0.43 | 24 | 83 | 8.1 |
| | 7 | 978 | 0.64 | 33 | 0.52 | 4 | 65 | 6.4 |

TABLE V

| EXAMPLES | | TENSILE STRENGTH (MPa) | YIELD RATIO | REDUCTION OF AREA (%) | FATIGUE LIMIT RATIO | $VL_{1000}$ (m/min) | SEPARATING MOMENT (kgf · cm) | SEPARATING MOMENT ($\times 10^4$N · m) |
|---|---|---|---|---|---|---|---|---|
| | | TEST DATA | | | | | | |
| INVENTION | 9 | 840 | 0.62 | 33 | 0.44 | 15 | 40 | 3.9 |
| | 10 | 831 | 0.62 | 34 | 0.44 | 14 | 27 | 2.6 |
| | 11 | 841 | 0.62 | 34 | 0.44 | 14 | 36 | 3.5 |
| | 12 | 876 | 0.66 | 29 | 0.45 | 10 | 38 | 3.7 |
| | 13 | 852 | 0.63 | 38 | 0.43 | 14 | 37 | 3.6 |
| PRIOR ART | 8 | 859 | 0.63 | 35 | 0.45 | 9 | 36 | 3.5 |
| | 9 | 918 | 0.66 | 27 | 0.45 | 5 | 27 | 2.6 |
| | 10 | 912 | 0.65 | 27 | 0.45 | 4 | 36 | 3.5 |

TABLE VI

| EXAMPLES | | TENSILE STRENGTH (MPa) | YIELD RATIO | REDUCTION OF AREA (%) | FATIGUE LIMIT RATIO | $VL_{1000}$ (m/min) | SEPARATING MOMENT (kgf · cm) | SEPARATING MOMENT ($\times 10^4$N · m) |
|---|---|---|---|---|---|---|---|---|
| | | TEST DATA | | | | | | |
| INVENTION | 14 | 907 | 0.64 | 34 | 0.49 | 8 | 39 | 3.8 |
| | 15 | 870 | 0.64 | 34 | 0.48 | 11 | 35 | 3.4 |
| | 16 | 928 | 0.64 | 35 | 0.48 | 7 | 29 | 2.8 |
| | 17 | 970 | 0.64 | 40 | 0.47 | 5 | 29 | 2.8 |
| | 18 | 827 | 0.62 | 36 | 0.43 | 20 | 34 | 3.3 |
| | 19 | 882 | 0.61 | 32 | 0.44 | 15 | 35 | 3.4 |
| | 20 | 880 | 0.65 | 36 | 0.46 | 34 | 35 | 3.4 |
| | 21 | 805 | 0.64 | 37 | 0.46 | 40 | 29 | 2.8 |
| | 22 | 959 | 0.65 | 38 | 0.46 | 30 | 28 | 2.7 |
| | 23 | 920 | 0.64 | 33 | 0.47 | 36 | 39 | 3.8 |
| | 24 | 871 | 0.63 | 34 | 0.48 | 17 | 39 | 3.8 |
| | 25 | 956 | 0.62 | 34 | 0.48 | 9 | 34 | 3.3 |
| | 26 | 989 | 0.64 | 31 | 0.48. | 7 | 29 | 2.8 |
| PRIOR ART | 11 | 1031 | 0.67 | 34 | 0.50 | 2 | 39 | 3.8 |
| | 12 | 1085 | 0.67 | 37 | 0.50 | 2 | 35 | 3.4 |
| | 13 | 1117 | 0.67 | 35 | 0.50 | 2 | 28 | 2.7 |

As understood from Tables IV to VI , Nos. 1–26 steel specimens of the present invention are superior to No. 1 steel specimen of the prior art (high carbon non-heat treated steel) in yield ratio, fatigue limit ratio and machinability and require a less separating force.

Nos. 2 and 3 prior art steel contains more Mn and/or N so that contraction of area and separating moment are large. No. 4 prior art steel contains less C and S and more Mn and V so that contraction of area and separating moment are large (particularly a large separating moment is needed). No. 5 prior art steel includes more C and less V so that the yield ratio and fatigue limit ratio are small. No. 6 prior art specimen includes less Si and more Mn and N so that the contraction of area and separating moment are large (particularly a large separating moment is necessary). No. 7 prior art specimen includes more Si, Mn and P and less V so that the fatigue limit ratio is small, machinability ($VL_{1000}$) is bad and separating moment is large.

Nos. 8–10 prior art specimens have a large amount of Al and/or Ti so that machinability is not good.

Nos. 11–13 prior art specimens have more Cr, Mo and Nb so that the tensile strength is large and machinability is bad.

In order to further raise machinability of the present invention steel, another set of specimens were prepared (Nos. 27–30 specimens). These specimens also contained at least one of the following elements; 0.4 wt % or less of Pb, Bi or Se, 0.050 wt % or less of Te, or 0.0030 wt % or less of Ca, in addition to the chemical composition of Nos. 1–26 specimens of the invention. The chemical compositions of Nos. 27–30 invention steel are shown in TABLE VII.

TABLE VII

| EXAMPLES | | CHEMICAL COMPOSITION C | Si | Mn | P | S | Cr | V | N | OTHERS |
|---|---|---|---|---|---|---|---|---|---|---|
| INVENTION | 27 | 0.57 | 1.10 | 0.38 | 0.051 | 0.044 | — | 0.099 | 0.0024 | Pb: 0.05<br>Ca: 0.0009 |
| | 28 | 0.57 | 1.08 | 0.35 | 0.056 | 0.047 | — | 0.102 | 0.0030 | Al: 0.033<br>Pb: 0.04<br>Ca: 0.0008 |
| | 29 | 0.56 | 1.25 | 0.35 | 0.055 | 0.047 | — | 0.102 | 0.0045 | Ti: 0.016<br>Bi: 0.05<br>Se: 0.04 |
| | 30 | 0.55 | 1.22 | 0.36 | 0.051 | 0.045 | 0.36 | 0.095 | 0.0047 | Te: 0.02 |

(UNIT: wt %)

The same tests as Nos. 1–26 invention specimens were also conducted to Nos. 27–30 specimens. Results of these tests are shown in Table VIII.

TABLE VIII

| EXAMPLES | | TEST DATA TENSILE STRENGTH (MPa) | YIELD RATIO | REDUCTION OF AREA (%) | FATIGUE LIMIT RATIO | $VL_{1000}$ (m/min) | SEPARATING MOMENT (kgf · cm) | (×$10^4$N · m) |
|---|---|---|---|---|---|---|---|---|
| INVENTION | 27 | 896 | 0.59 | 30 | 0.46 | 22 | 40 | 3.9 |
| | 28 | 908 | 0.60 | 27 | 0.46 | 23 | 30 | 2.9 |
| | 29 | 937 | 0.61 | 29 | 0.47 | 22 | 33 | 3.2 |
| | 30 | 928 | 0.62 | 30 | 0.47 | 14 | 27 | 2.6 |

Nos. 27–30 invention specimens contain about 0.05 wt % of S and other machinability-improving elements as shown in Table VII so that each steel possesses a relatively high tensile strength but demonstrates good machinability as seen in Table VIII.

It is feasible to manufacture a lightweight and inexpensive connecting rod from the steel of the invention. As a result, the connecting rod of the invention contributes to weight reduction, increase of output and improvement of quality of an internal combustion engine. The joinable steel machine part fabricated by fracture method according to the present invention is not limited to the connecting rod. For example, a divisible bearing support used in a cylinder head, a cylinder block of the internal combustion engine or a differential cage may be machine parts made by fracturing the steel of the invention. Parts supporting a shaft or rotating element may also be machine parts made by fracturing the steel of the invention.

The above described steel and machine parts are disclosed in Japanese Patent Application No. 9-317347 filed Nov. 18, 1997 and the entire disclosure thereof is incorporated herein by reference. This application claims priority of the above identified Japanese Application.

What is claimed is:

1. A steel for machine structural use, having the following chemical composition:

C: 0.45–0.60 wt %,

Si: 0.50–2.00 wt %,

Mn: 0.10 to less than 0.30 wt %,

P: 0.01–0.10 wt %,

S: 0.01–0.20 wt %,

V: 0.08–0.15 wt %, and

N: 0.0020 to less than 0.0050 wt %, with the remainder being Fe and impurities inevitably included, and wherein an inner structure of the steel is a ferrite-pearlite structure.

2. The steel as defined in claim 1, wherein the chemical composition further includes:

Al: 0.005–0.050 wt % and/or

Ti: 0.005–0.050 wt %.

3. The steel as defined in claim 1, wherein the chemical composition further includes one or two or all of:

Nb: 0.05–0.30 wt %,

Cr: 0.10–0.50 wt % and

Mo: 0.05–0.50 wt %.

4. The steel as defined in claim 2, wherein the chemical composition further includes one or two or all of:

Nb: 0.05–0.30 wt %,

Cr: 0.10–0.50 wt % and

Mo: 0.05–0.50 wt %.

5. The steel as defined in claim 1, wherein the chemical composition further includes at least one of:

0.4 wt % or less of Pb, Bi or Se, 0.050 wt % or less of Te, or 0.0030 wt % or less of Ca.

6. The steel as defined in claim 2, wherein the chemical composition further includes at least one of:

0.4 wt % or less of Pb, Bi or Se, 0.050 wt % or less of Te, or 0.0030 wt % or less of Ca.

7. The steel as defined in claim 3, wherein the chemical composition further includes at least one of:

0.4 wt % or less of Pb, Bi or Se, 0.050 wt % or less of Te, or 0.0030 wt % or less of Ca.

8. The steel as defined in claim 4, wherein the chemical composition further includes at least one of:

0.4 wt % or less of Pb, Bi or Se, 0.050 wt % or less of Te, or 0.0030 wt % or less of Ca.

9. An article of manufacture made by the following steps:

A) preparing a steel having the following chemical composition:

C: 0.45–0.60 wt %,

Si: 0.50–2.00 wt %,

Mn: 0.10 to less than 0.30 wt %,

P: 0.01–0.10 wt %,

S: 0.01–0.20 wt %,

V: 0.08–0.15 wt %, and

N: 0.0020 to less than 0.0050 wt %, with the remainder being Fe and impurities inevitably included, and wherein an inner structure of the steel is a ferrite-pearlite structure;

B) hot rolling or hot forging the steel to a particular shape; and

C) dividing the steel of particular shape by fracture process.

10. The article of manufacture as defined in claim 9, wherein the chemical composition further includes:

Al: 0.005–0.050 wt % and/or

Ti: 0.005–0.050 wt %.

11. The article of manufacture as defined in claim 9, wherein the chemical composition further includes one or two or all of:

Nb: 0.05–0.30 wt %,

Cr: 0.10–0.50 wt % and

Mo: 0.05–0.50 wt %.

12. The article of manufacture as defined in claim 10, wherein the chemical composition further includes one or two or all of:

Nb: 0.05–0.30 wt %,

Cr: 0.10–0.50 wt % and

Mo: 0.05–0.50 wt %.

13. The article of manufacture as defined in claim 9, wherein the chemical composition further includes:

0.4 wt % or less of Pb, Bi or Se, 0.050 wt % or less of Te, or 0.0030 wt % or less of Ca.

14. The article of manufacture as defined in claim 10, wherein the chemical composition further includes:

0.4 wt % or less of Pb, Bi or Se, 0.050 wt % or less of Te, or 0.0030 wt % or less of Ca.

15. The article of manufacture as defined in claim 11, wherein the chemical composition further includes:

0.4 wt % or less of Pb, Bi or Se, 0.050 wt % or less of Te, or 0.0030 wt % or less of Ca.

16. The article of manufacture as defined in claim 12, wherein the chemical composition further includes:

0.4 wt % or less of Pb, Bi or Se, 0.050 wt % or less of Te, or 0.0030 wt % or less of Ca.

17. A method of manufacturing an article comprising the steps of:

A) preparing a steel having the following chemical composition:

C: 0.45–0.60 wt %,

Si: 0.50–2.00 wt %,

Mn: 0.10 to less than 0.30 wt %,

P: 0.01–0.10 wt %,

S: 0.01–0.20 wt %,

V: 0.08–0.15 wt %, and

N: 0.0020 to less than 0.0050 wt %, with the remainder being Fe and impurities inevitably included, and wherein an inner structure of the steel is a ferrite-pearlite structure;

B) hot rolling or hot forging the steel to a particular shape; and

C) dividing the steel of particular shape by fracture process.

18. The method as defined in claim 17, wherein the chemical composition further includes:

Al: 0.005–0.050 wt % and/or

Ti: 0.005–50 wt %.

19. The method as defined in claim 17, wherein the chemical composition further includes one or two or all of:

Nb: 0.05–0.30 wt %,

Cr: 0.10–0.50 wt % and

Mo: 0.05–0.50 wt %.

20. The method as defined in claim 17, wherein the chemical composition further includes:

0.4 wt % or less of Pb, Bi or Se, 0.050 wt % or less of Te, or 0.0030 wt % or less of Ca.

* * * * *

UNITED STATES PATENT AND TRADEMARK OFFICE

CERTIFICATE OF CORRECTION

PATENT NO : 5,993,571

DATED : November 30, 1999

INVENTOR(S) : Hirohito Eto, Hiromasa Takada, Tetsuroh Hashiguchi, Osamu Ohyama

It is certified that error appears in the above-identified patent and that said Letters Patent is hereby corrected as shown below:

Col. 16, line 35
replace "Ti: 0.0050-50 wt %."
with --Ti: 0.0050-0.050 wt%--.

Signed and Sealed this

Twelfth Day of September, 2000

*Attest:*

Q. TODD DICKINSON

*Attesting Officer*

*Director of Patents and Trademarks*